US006379464B1

(12) United States Patent
Martel

(10) Patent No.: US 6,379,464 B1
(45) Date of Patent: Apr. 30, 2002

(54) APPARATUS FOR APPLYING MATERIAL TO A TARGET IN RELATIVE MOTION TO A DISPENSER

(75) Inventor: Thomas J. Martel, DeWitt, NY (US)

(73) Assignee: K-G Devices Corporation, De Witt, NY (US)

( * ) Notice: Subject to any disclaimer, the term of this patent is extended or adjusted under 35 U.S.C. 154(b) by 0 days.

(21) Appl. No.: 09/364,092

(22) Filed: Jul. 30, 1999

(51) Int. Cl.[7] ..... B05C 11/00
(52) U.S. Cl. ..... 118/672; 118/674; 118/688
(58) Field of Search ..... 118/672, 674, 118/688, 691

(56) References Cited

U.S. PATENT DOCUMENTS

| | | | | |
|---|---|---|---|---|
| 2,961,990 A | | 11/1960 | Wruck | |
| 4,357,900 A | | 11/1982 | Buschor | |
| 4,421,800 A | | 12/1983 | Schoenberg et al. | |
| 4,500,937 A | | 2/1985 | Matt | |
| 4,527,510 A | * | 7/1985 | Arndt | 118/669 |
| 4,556,305 A | | 12/1985 | Osegowitsch | |
| 4,941,428 A | * | 7/1990 | Engel | 118/680 |
| 5,134,962 A | * | 8/1992 | Amada et al. | 118/688 |
| 5,298,277 A | | 3/1994 | Hirose | |
| 5,308,398 A | | 5/1994 | Ottl et al. | |
| 5,334,249 A | | 8/1994 | Osbon | |
| 5,589,226 A | | 12/1996 | Geul | |
| 5,683,752 A | | 11/1997 | Popp et al. | |
| 5,711,989 A | * | 1/1998 | Ciardella et al. | 118/697 |
| 5,988,052 A | * | 11/1999 | Abler | 118/24 |

* cited by examiner

*Primary Examiner*—Bret Chen
(74) *Attorney, Agent, or Firm*—Brian B. Shaw, Esq.; Stephen B. Salai, Esq.; Harter, Secrest & Emery LLP

(57) ABSTRACT

A method and apparatus for selectively applying, a material to a target moving along a path is disclosed. The apparatus includes at least one detector for identifying an upstream position of the target; a dispenser spaced downstream from the detector by an offset distance, the dispenser configured for selectively releasing material to contact the target; a velocity sensor for creating a velocity signal proportional to a velocity of the target; and a controller for selectively varying the offset distance in response to the velocity signal.

18 Claims, 4 Drawing Sheets

APPARATUS FOR APPLYING MATERIAL TO A TARGET IN RELATIVE MOTION TO A DISPENSER

FIELD OF THE INVENTION

The present invention relates to the transfer of material between objects in relative motion, and more particularly to a control system for regulating the application of a solid or liquid material to a moving target.

BACKGROUND OF THE INVENTION

The application of liquid or solid material to a target in relative motion includes applying ink, paint, or adhesives to a substrate; applying cleaning fluids, or applying decorative edible materials such as icing, sugar, or batter.

Traditionally the application of the material to a target is signaled to commence by an electrical impulse from a sensor (e.g., a photoelectric "eye"). The impulse from the sensor is transmitted to a dispenser. These devices are generally divided into two main categories: (i) those that actuate the dispenser after a time delay to locate the point of application on the target (time delay systems) and (ii) those that utilize velocity or location information from an external sensor to control the moment of application (velocity/position sensor systems).

Time delay systems can be operator adjusted to position the point of application on the target. Velocity/position sensor systems can be used over a relatively wide range of conditions compared to the time delay systems, but the velocity/position sensor systems require a somewhat more complex control method utilizing velocity (or position) information from the external sensor.

In the velocity/position sensor systems, the greatest difficulties arise because of the need to compensate for the time delay between the instant that a control unit or sensor actuates the dispenser, by transmitting a signal to it, and the instant that the material released by the dispenser actually contacts the target. The delay between the instant that the control unit issues an initiate or open command and the instant that the material makes contact with the target is often referred to as "delivery delay". Delivery Delay can be reduced, but not eliminated, thus always resulting in some placement error. Accuracy in placement of the application material is at least partially dependent upon the delivery delay. The placement error resulting from delivery delay increases as the relative target speed increases.

Most velocity/position sensor systems can compensate for delivery delay under steady-state velocity conditions. Thus, if the targets are moving at a constant velocity, the effects of delivery delay can be reduced by using mathematical calculations to "factor in" the dispenser delay interval and material time-of-flight, and advance the moment of activation of the dispenser by an amount which approximates the delay interval.

One approach for compensating for delivery delay entails decreasing the size of the photo detection area of a photoeye. This approach requires that calculations be done much more frequently to account for variations in the conveyor speed. Thus, there would be a need for more frequent inputs to the control logic which controls the dispenser.

Delivery delay is not well compensated by the prior art devices which rely on the simple mathematical model of geometry. Because the timing of prior devices is based on a tachometer measurement of conveyor speed, delivery delay could only be done to the nearest range cell, the smallest unit measured. At higher conveyor speeds, the range cells must be made larger to avoid exceeding the computational bandwidth of the control unit, resulting in a potentially noticeable error in the placement of a bead under conditions of changing conveyor speed. Because an operator-adjustable multiplier is used, the dispensed material tends to fall between two range cells. Since microprocessors in the controllers had other tasks, any appreciable change in conveyor speed would introduce an error in bead position. Adjustments could only be made once per item, therefore, long bead applications would vary greatly from its desired position due to changes in conveyor speed.

Therefore, the need exists for a method and apparatus for selectively applying material to a target, wherein delivery delay is inherently accommodated. A need also exists for a system that can adjust to varying target speeds. The need exists for a simple technique to accurately place material on a moving target wherein the target speed may have some variation and the target size may be variable and relatively small.

SUMMARY OF THE INVENTION

The present invention includes an apparatus for selectively applying a material to a target moving along a path and includes a detector for identifying position of the target along the path; a dispenser spaced from the detector by an offset distance, the dispenser configured for selectively releasing material to contact the target; a velocity sensor for creating a velocity signal proportional to a velocity of the target; and a controller for selectively varying the offset distance in response to the velocity signal.

In a particular embodiment, an actuator moves the detector in a direction opposite to the direction of conveyor travel as the conveyor speed increases and moves the detector in the same direction as the conveyor travel as the conveyor speed is decreases. In a further configuration, multiple position detectors may be employed to provide further control signals in the application of the material.

The present invention addresses at least three separate sources of delivery delay in a typical application system:

1. Valve motion delay, resulting from the moving elements of the valve changing position at finite speed. For example, if mechanical solenoids are employed, the magnetic fields generated within the solenoids require appreciable amounts of time to build up when the valve is energized or decay when the valve is de-energized;
2. Time of flight delay resulting from the finite speed at which the material is propelled across the distance between the valve/nozzle assembly and the target location; and
3. Column inertia resulting from the mass of the column of delivery material resident in a delivery material supply, and the viscosity of the material. Because of these physical properties, the column requires some finite amount of time to get moving when the open command is sent to the valve. This delay is influenced by the delivery pressure and temperature.

The present invention accommodates changes in the conveyor speed and reduced spacing between targets. The present device also offers the advantages of:

1. employing physical geometry to accomplish what is previously accomplished by means of computational power as through a microprocessor in a control unit;
2. compensating for acceleration of target items at rates far higher than can be achieved by present methods based on digital control techniques; and 3. controlling the deposition of material with position resolution considerably greater than can be achieved through prior devices.

DETAILED DESCRIPTION OF THE PREFERRED EMBODIMENTS

Figure 1:
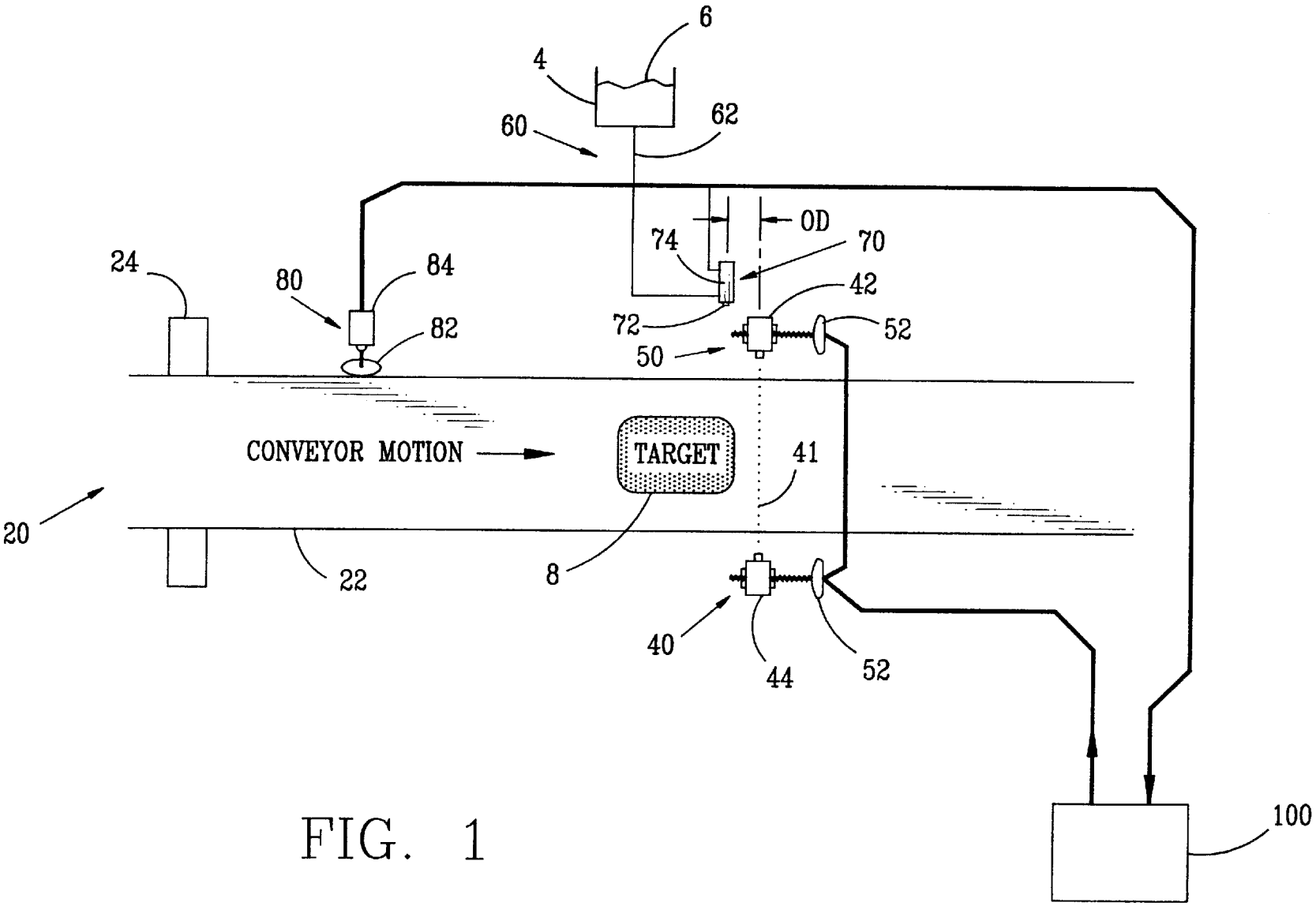
FIG. 1 is a schematic view of a first embodiment of the present invention.

FIG. 1 shows a first embodiment of the present invention for selectively applying material 6 from a reservoir 4 to a target 8 in relative motion. As shown in FIG. 1, the present invention includes a conveyor assembly 20, a detector assembly 40, a dispenser assembly 60, a velocity sensor 80, and a controller 100. Generally, the dispenser assembly 60, velocity sensor 80 and the controller 100 are disposed at a fixed location along the conveyor assembly 20, and the detector assembly 40 is moveable along the conveyor assembly.

Conveyor Assembly

The conveyor assembly 20 translates the target 8 along a predetermined path, and preferably passes the target within an operable distance of the dispenser assembly 60. The conveyor assembly 20 includes a conveyor 22 that may be any of a variety of configurations such as a belt, rollers or rack system. The conveyor assembly 20 also includes a drive 24 for translating the conveyor 22. The drive 24 may include drive rollers, a winding drum, hooks, or a pulley mechanism. It understood the conveyor 22 may travel along a straight path or a curvilinear path.

Detector Assembly

The detector assembly 40 is used to identify a position 41 of the target 8 at a given time and location. The detector assembly 40 includes a source 42 and a detector 44 spaced from the source. The position 41 monitored by detector 44 is located at an offset distance OD from the dispenser assembly 60.

The offset distance OD is shown as a distance extending from the dispenser assembly 60 downstream to the detector assembly 40. The offset distance OD may vary from being substantially coincident with the dispenser assembly to several inches or even feet from the dispenser assembly, depending upon the shape of the target 8, the material 6 and the speed of conveyor 22 (target). It is understood the offset distance OD may also be located to extend from the dispenser assembly 60 upstream to the detector assembly 40.

The detector 44 is a sensor which may be a photodetector, a photo electric cell, a photo conductive cell or a photo voltaic cell. However, it is understood, the detector 44 may be sensitive to any desired portion of the electromagnetic spectrum.

The source 42 may be a light source such as a light emitting diode, a laser, an infrared source or a visible light source. It is understood the source 42 and detector 44 are compatible. Although the detector assembly 40 is described in terms of a source 42 and a detector 44, it is understood that in some operating environments, the detector can monitor an ambient condition and create a signal in response to a change in the ambient condition resulting from passage of the target 8. The detector assembly 40 may thus function with the detector 44 alone.

At least, the detector 44 of the detector assembly 40 is connected to an actuator 50 for selectively varying the location of the 10 detector 44 along the path of the conveyor 22 that is varying the offset distance. In a preferred embodiment, the detector assembly 40 is connected to actuators 50 for movement along the path in the upstream and downstream direction. The actuators 50 may be any of a variety of mechanisms such a screws, levers, pistons or cams. Further, the actuators 50 may be mechanically, hydraulically or pneumatically driven, and configured as a linear actuator.

In a preferred configuration, both the source 42 and the detector 44 are equipped with actuators 50. However, it is understood the detector assembly 40 may be selectively translated to varying the offset distance OD by a single actuator 50. The actuators 50 are linear actuators individually driven by respective drivers 52. The actuators 50 are configured to selectively move the source 42 and the detector 44 in either the upstream or downstream direction with respect to the conveyor travel.

In a preferred configuration, the actuator 50 translates at least the detector 44 less than approximately 24 inches along the path. However, this value may be substantially varied as dictated by the desired operating parameters.

Dispenser Assembly

The dispenser assembly 60 controls the transfer of the material 6 from the reservoir 4 to the target 8. The dispenser assembly 60 is operably connected to the controller 100. The specific dispenser assembly 60 is at least partially dictated by the material to be transferred. The dispenser assembly 60 includes a transfer line 62 extending from the reservoir 4 to a valve-nozzle assembly 70. Generally, the reservoir 4 presents the material to the valve-nozzle assembly 70 under a predetermined pressure. However, it is understood a pressure generator may be disposed intermediate the reservoir 4 and valve-nozzle assembly 70. The valve-nozzle assembly 70 is controlled to selectively release the material 6. The valve-nozzle assembly 70 includes a nozzle 72 for providing a particular pattern of the material 6 as it contacts the target 8. The valve-nozzle-assembly 70 also includes a valve 74 for selectively releasing material through the nozzle 72.

Velocity Sensor

The velocity sensor 80 provides a signal corresponding to the velocity of the target 8 along the conveyor 22. Generally, the velocity is attributed to the target 8 at the location of the velocity sensor 80. The velocity sensor 80 may be any of a variety of systems. Its selection is at least partially dictated by cost considerations.

In a preferred configuration, the velocity sensor 80 includes an idler wheel 82 connected to the conveyor assembly 20 and a speed or position transducer 84 connected to the idler wheel. The transducer 84 is preferably a tachometer generator. The tachometer generator produces an analog voltage having an amplitude which represents the instantaneous speed of the conveyor 22, and hence target 8 at the particular location along the conveyor. The analog voltage is converted to a pulse train by a linear voltage controlled oscillator circuit 86. The pulses generated by the linear voltage controlled oscillator circuit 86 correspond to fixed intervals of distance along the conveyor 22. These distance intervals represent the smallest quanta of motion to which the controller 100 can detect or respond. The velocity of the conveyor 22 is thus measured and a signal corresponding to the velocity of the conveyor, and hence target is generated.

The Controller

The controller 100 is operably connected to the velocity sensor 80, the detector assembly 40 and the dispenser assembly 60 for selectively responding to and/or actuating the respective component. The controller 100 directs the dispenser assembly 60 to permit passage of material through the nozzle 72. The controller 100 may also calculate velocity of the target 8 from the velocity sensor signal. Further, the controller 100 may recognize the position of the target 8 at the detector location from the signal generated by the detector assembly 40. The controller 100 may be a dedicated computer or a control system. Alternatively, the controller 100 may be an integrated circuit component embedded in a larger control system.

Figure 2:
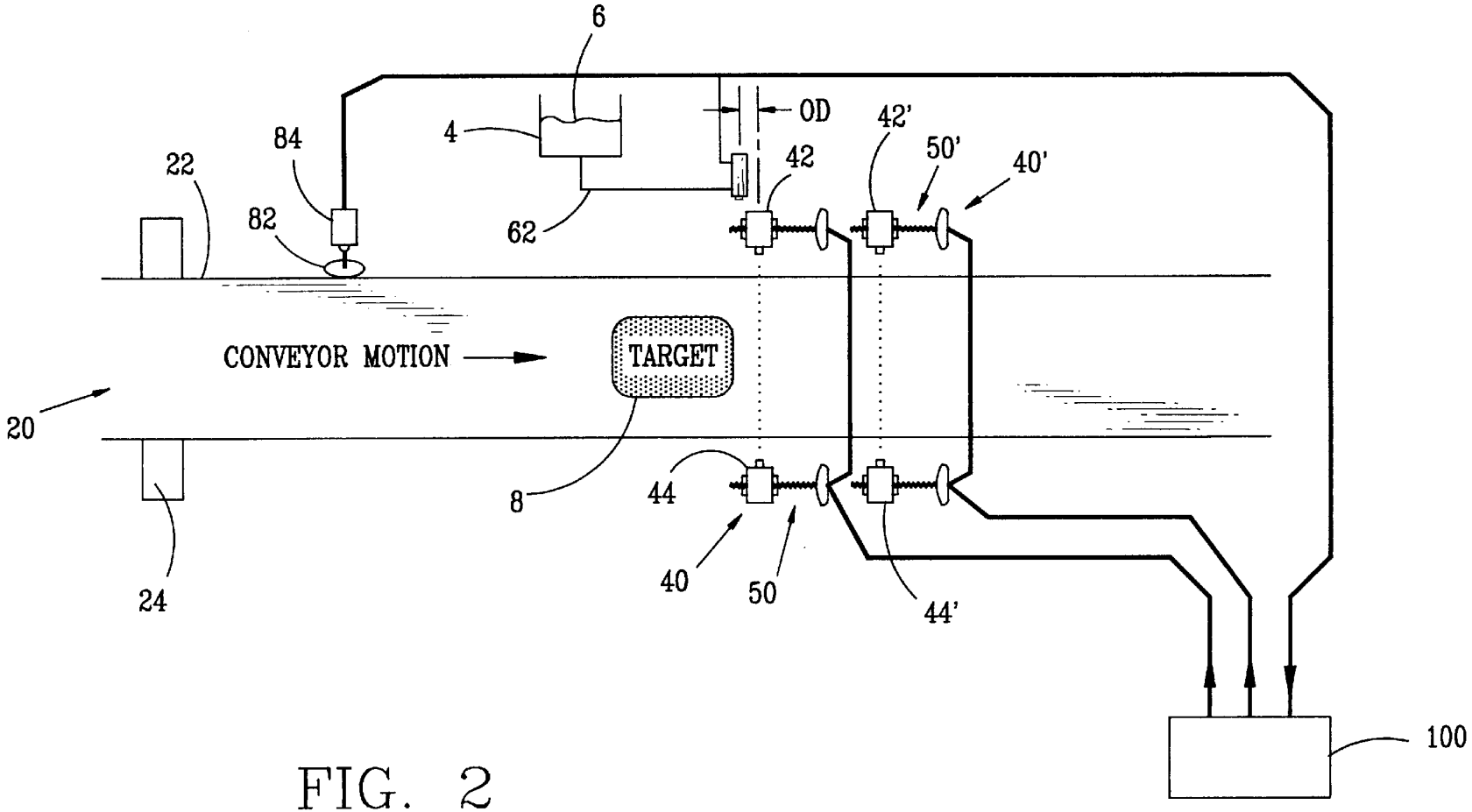
FIG. 2 is a schematic of a second embodiment.

FIG. 2 represents a second configuration of the invention, where two detector assemblies 40, 40' are employed, wherein a first upstream detector assembly 40 is used to provide a "valve open signal" and a second downstream detector 40' assembly is located downstream of the first detector assembly 40 to provide a "valve closed signal."

In addition to the components set forth in the description of FIG. 1, the apparatus of FIG. 2 further includes first and second actuators 50, 50'. These components are similar to the ones described in the first embodiment, such that the first actuator 50 is operably connected to the upstream detector assembly 40 and the second actuator 50' is connected to the downstream detector assembly 40'.

The use of two detector assemblies in the second embodiment allows the dedication of a respective detector assembly 40 to a specific function. Specifically, the upstream detector assembly 40 generates a commencement signal and the downstream detector assembly 40' generates a termination signal. That is, the upstream detector assembly 40 signals for material flow through valve-nozzle assembly 70 and the downstream detector assembly signals 40' for stopping material flow through the valve-nozzle assembly.

Figure 3:
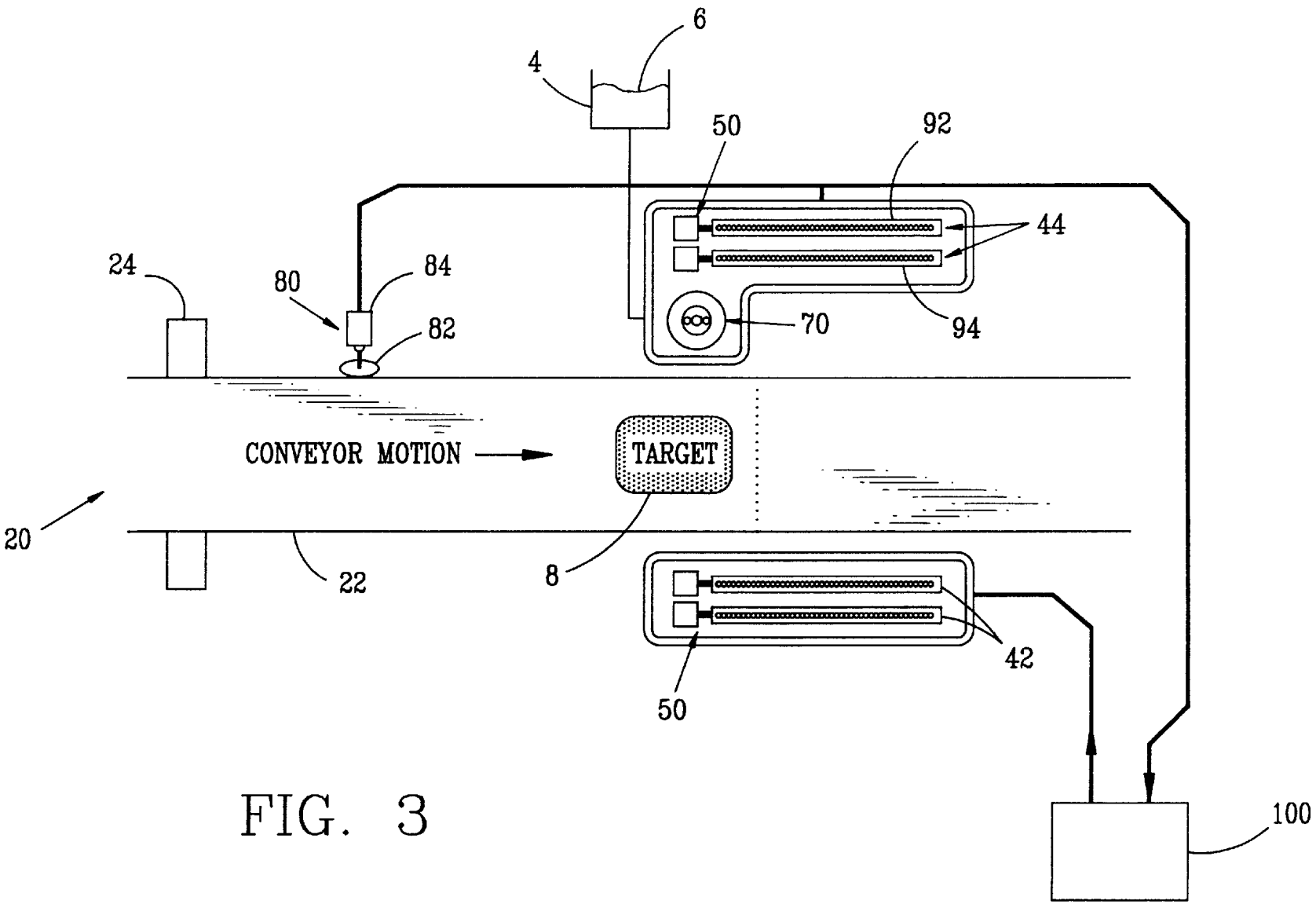
FIG. 3 is a schematic of a third embodiment of the invention.

FIG. 3 shows a third embodiment having a first detector array 92 and a second detector array 94. Corresponding first and second source or emitter arrays 42 are shown. The arrays 92, 94 have a longitudinal axis that preferably extends parallel to the direction of conveyor travel. The first and the second detector arrays may be transistor arrays. Similar to the previous embodiments, the detectors 92, 94 are translatable along the conveyor 22 in the direction of conveyor travel and opposed to the direction of conveyor travel by corresponding actuators. In this embodiment, the arrays 92, 94 are used to more finely define distances to more precisely deliver material from the valve-nozzle assembly 70 to the target 8.

Figure 4:
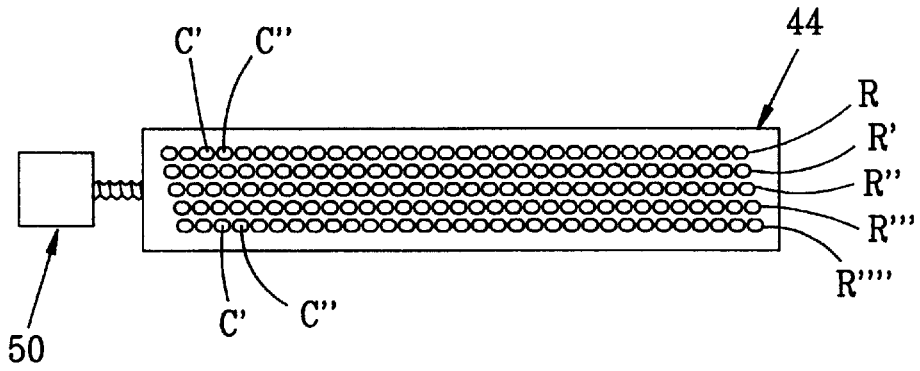
FIG. 4 is a fourth configuration of a portion of a detection assembly, employing a two-dimensional array of staggered detectors.

FIG. 4 shows a fourth configuration of a detector assembly 40 for use in the present invention. The fourth configuration of the detector assembly 40 includes a two dimensional array of detectors 44. As shown in FIG. 4, the detector 44 includes a plurality of rows R and columns C formed by individual detectors. Resolution of the detector assembly 40 is determined by the distance or spacing between adjacent detectors. Therefore, resolution of the detector assembly 40 along the travel direction of the conveyor 22 is determined by the individual detectors in a given row R.

In the embodiment of FIG. 4, the detectors are evenly spaced within each row R and the rows are offset along the travel direction of the conveyor 22. That is, the otherwise blank space between two adjacent detectors in a given row R is "occupied" by a detector in one of the remaining rows. The range of detection along the array having offset rows is substantially continuous. The "staggered center" orientation of the rows R thus improves the resolution in the along the axis of target motion.

As in the previous configurations, the detectors 44 are connected to actuators 50 for translation upstream and downstream of the travel direction of the conveyor 22.

Figure 5:
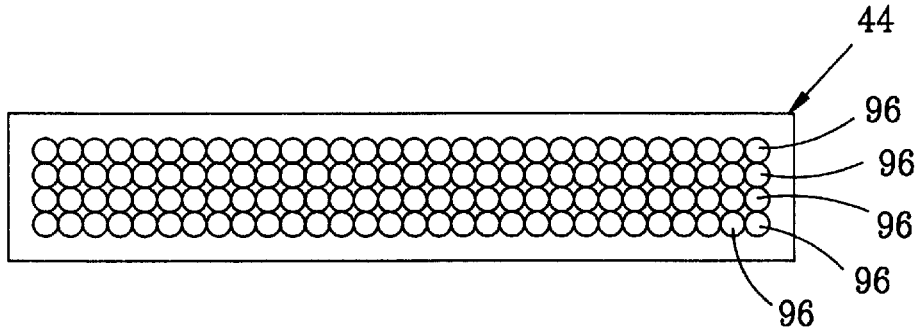
FIG. 5 illustrates a fifth embodiment having an array of individual optical fibers.

FIG. 5 shows a fifth embodiment of the detector assembly 40, wherein the detector 44 includes an array of optical fibers 96. Each fiber 96 has a first end fixed in an array that locates the fibers in a predetermined pattern. Light from the source 42 passes into the anchored ends of the fibers 96. A signal generator is operably connected to the fibers 96 to produce a signal in response to the entering light.

Figure 6:
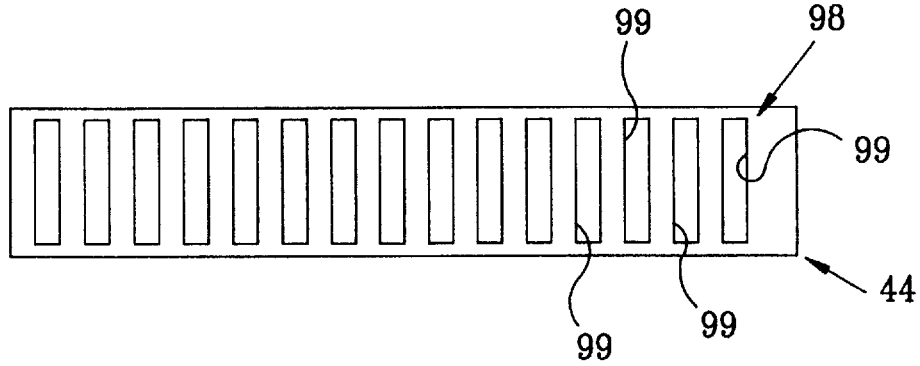
FIG. 6 illustrates a sixth embodiment having an "aperture mask" to "space-modulate" the image plane.

FIG. 6 shows a sixth configuration of the detector assembly 40 wherein the detector includes an aperture mask 98 to space modulate the passage of a target 8. Preferably, the aperture mask 98 includes a multitude of light transmissive apertures 99. In a preferred construction, the light transmissive apertures 99 are evenly spaced in an array. The aperture mask 98 may include a series of linear apertures (slits) located optically intermediate the source 42 and one or more detectors 44. As a target 8 moves across the field of view, the light from source 42 causes a shadow to sweep across the aperture mask 98, such that the apertures 99 convert the shadow into a series of discrete steps of intensity change. Electronic circuitry converts these steps into an accurate representation of the location of the leading or trailing edge of the target 8.

In Operation

The present system compensates for the initial open delay by adjusting the location of the detector assembly 40 with respect to the dispenser assembly 60. The open delay can be accurately compensated by translating the detector assembly 40 to increase the offset distance OD as the speed of the conveyor 22 increases. Thus, the controller 100 causes the offset distance OD to increase (moves the detector assembly 40 opposite the conveyor travel) as conveyor speed increases. The controller 100 further reduces the offset distance OD (moves the detector assembly 40 with the conveyor travel) as the conveyor speed decreases. By coordinating variances of the offset distance OD in real time with changes in conveyor speed, the remaining primary error to be addressed would be changes in conveyor speed during actual time off light intervals (the fill flight time of the material from the nozzle 72 to the target 8.)

In operation, the conveyor assembly 20 transports the target 8 along the conveyor 22. Upon the target 8 passing the detector assembly 40, the target is detected and a corresponding signal is sent to the controller 100.

Both the source 42 and the detector 44 are operably connected to a corresponding linear actuators 50. The linear actuators 50 are driven by their respective drive motors 52. The linear actuators to move the source 42 and the detector 44 to the left, opposite the direction of conveyor motion, as conveyor speed increases and to the right as conveyor speed decreases.

Target velocity is determined by the velocity sensor 80. A velocity signal is created and sent to the controller 100. The controller 100 directs the actuator 50 to adjust the location of the detector assembly.

The configuration of FIG. 1, thereby adjusts for delivery delay for a single bead and for the "on" or "open" delay. The amount of translation of the detector assembly 40 is determined by the product of the conveyor speed and a constant of proportionality, K. As long as the detector assembly 40 is moved by a distance that is exactly equal to the constant K, multiplied by the speed of the conveyor, the resultant effect is to advance the moment of valve actuation by a fixed interval of time.

Referring to FIG. 2, the "off" or "close" delay is addressed by the downstream detector assembly 40' which generates an "end" or "close" signal. The offset distance OD for the downstream detector assembly 40' is provided by the corresponding actuator 50 in response to the target velocity and the corresponding proportionally constant K.

Each detector assembly 40 instantaneously sends a signal to the controller 100. The controller 100 includes a "flip-flop" to combine the separate the signals from the respective detector assemblies 40, 40' into a single dispenser assembly open/close loop. The controller 100 adjusts the offset distance of the upstream and the downstream detector assemblies via the actuator 50. Thus, delivery delay is accommodated by purely mechanical system. Thus, the prior limitations of range cell resolution.

Further, the present configuration obviates the prior limitation of the control units measuring time only in terms of distance. That is, unlike the prior systems which converted a time interval (that of the "delivery delay"), to a distance interval and real time. Thus, prior delivery delay compensation could only be done to the nearest range cell. So at higher conveyor speeds, the range cells had to be made larger so as to avoid exceeding the available computation band width. Further, where prior systems may encounter a dither resulting from the rounding errors in relation to certain conveyor speeds, the prior invention removes the dither issue. In addition, the present system allows for real time compensation of the offset distance, and hence, conveyor speed changes. Similarly, any variance in the conveyor speed during a length of deposition of material, can be accounted for in the present system.

Other improvements, modifications and embodiments will become apparent to one of ordinary skill in the art upon review of this disclosure. Such improvements, modifications, and embodiments are considered to be within the scope of the invention as defined by the following claims.

In the claims:

1. An apparatus for selectively applying a quantity of material from a source to a target moving along a path, comprising:

(a) a detector for identifying a position of the target along the path, the detector movable with respect to the path in an upstream direction and a downstream direction;

(b) a dispenser spaced from the detector by an offset distance, the dispenser configured for selectively releasing material to contact the target;

(c) a velocity sensor for creating a velocity signal proportional to a velocity of the target; and (d) a controller for selectively varying the offset distance in response to the velocity signal.

2. The apparatus of claim 1, wherein the controller varies the offset distance in real time in response to the velocity signal.

3. The apparatus of claim 1, wherein the offset distance is proportional to a velocity of the target multiplied by a constant of proportionality.

4. The apparatus of claim 3, wherein the constant of proportionality is linear.

5. The apparatus of claim 1, wherein the controller causes a reduction in the offset distance in response to a decrease in a velocity of the target.

6. The apparatus of claim 1, wherein the controller causes an increase in the offset distance in response to an increase in a velocity of the target.

7. An apparatus for selectively applying a material to a target moving along a path from a source of material, comprising:

(a) a first detector for generating a first signal in response to the target occupying a first position;

(b) a second detector for generating a second signal in response to the target occupying a second position;

(c) a dispenser spaced from the first detector by a first offset distance and spaced from the second detector by a second offset distance, the dispenser configured to selectively release material to contact the target;

(d) a velocity sensor for creating a signal proportional to a velocity of the target; and (e) a controller operably connected to the first detector, the second detector, the dispenser and the velocity sensor for selectively moving one of the first detector and the second detector to vary one of the corresponding first offset distance and the second offset distance.

8. The apparatus of claim 7, wherein the controller is selected to initiate dispensing of the material in response to the first signal and terminate dispensing of the material in response to the second signal.

9. An apparatus for selectively applying a material to a target moving along a path from a source, comprising:

(a) a first plurality of detectors operably aligned with the path for generating a time series of valve open signals in response to the target triggering the first plurality of detectors;

(b) a second plurality of detectors for generating a time series of valve closed signals in response to the target triggering the second plurality of detectors;

(c) a dispenser spaced from the first plurality of detectors by a first offset distance and spaced from the second plurality of detectors by a second offset distance, the dispenser configured to selectively release material to contact the target;

(d) a velocity sensor for creating a signal proportional to a velocity of the target; and (e) a controller operably connected to the first plurality of detectors, the second plurality of detectors, the dispenser and the velocity sensor for selectively varying one of the first offset distance and the second offset distance.

10. The apparatus of claim 9, wherein each of the first and second plurality of detectors comprises a detector strip.

11. The apparatus of claim 9, wherein the controller is selected to initiate dispensing of the material in response to the time series of valve open signals and terminate dispensing of the material in response to the time series of valve closed signals.

12. An apparatus for selectively applying a material to a target moving along a path from a source, comprising:

(a) detection circuitry operably aligned with the path for generating a series of valve commands in response to the target;

(b) a dispenser spaced from the detection circuitry by an offset distance, the dispenser configured to selectively release material to contact the target;

(c) a velocity sensor for creating a signal proportional to a velocity of the target; and (d) a controller operably connected to the detection circuitry, the dispenser and the velocity sensor for selectively varying the offset distance between the dispenser and the detection circuitry.

13. The apparatus of claim 12, wherein the detection circuitry includes one of a solid-state imaging array, an array of individual optical fibers and an aperture mask.

14. The apparatus of claim 13, wherein the detection circuitry comprises a solid-state imaging array.

15. The apparatus of claim 14, wherein the solid-state imaging array consists of a two-dimensional arrangement of phototransistors.

16. The apparatus of claim 15, wherein the detection circuitry is movable along the path.

17. The apparatus of claim 12, wherein the controller is selected to initiate dispensing of the material and terminate dispensing of the material in response to the signal.

18. An apparatus for selectively applying a quantity of material from a source to a target moving along a path, comprising:

(a) a detector for identifying a position of the target along the path;

(b) a dispenser spaced from the detector by a variable offset distance;

(c) a velocity sensor operably aligned with the path for creating a velocity signal proportional to a velocity of the target; and (d) a controller for selectively varying the offset distance in response to the velocity signal.

* * * * *